US007585352B2

(12) United States Patent
Dunn

(10) Patent No.: US 7,585,352 B2
(45) Date of Patent: Sep. 8, 2009

(54) GRID ELECTROSTATIC PRECIPITATOR/FILTER FOR DIESEL ENGINE EXHAUST REMOVAL

(76) Inventor: John P. Dunn, 240 Stuart St., Apt. A, Horseheads, NY (US) 14845

( * ) Notice: Subject to any disclaimer, the term of this patent is extended or adjusted under 35 U.S.C. 154(b) by 298 days.

(21) Appl. No.: 11/380,714

(22) Filed: Apr. 28, 2006

(65) Prior Publication Data

US 2006/0187609 A1 Aug. 24, 2006

Related U.S. Application Data

(63) Continuation-in-part of application No. 10/872,981, filed on Jun. 21, 2004, now Pat. No. 7,105,041, which is a continuation-in-part of application No. 10/225,523, filed on Aug. 21, 2002, now Pat. No. 6,773,489.

(60) Provisional application No. 60/722,026, filed on Sep. 29, 2005, provisional application No. 60/716,425, filed on Sep. 13, 2005, provisional application No. 60/675,575, filed on Apr. 28, 2005.

(51) Int. Cl.
*B03C 3/014* (2006.01)

(52) U.S. Cl. ..... 95/73; 95/78; 95/79; 96/60; 96/62; 96/76; 96/77; 96/97

(58) Field of Classification Search ..... 95/73, 95/78, 79; 96/60, 62, 74, 76, 77, 96–98
See application file for complete search history.

(56) References Cited

U.S. PATENT DOCUMENTS 2,361,946 A 11/1944 Johnson et al.
2,803,344 A 8/1957 Morrison
2,836,725 A 5/1958 Vyverberg
3,566,110 A 2/1971 Gillespie et al.
3,635,340 A 1/1972 Dunn
3,739,554 A 6/1973 Whetten et al.
3,768,258 A 10/1973 Smith et al.
3,820,306 A 6/1974 Vincent
3,826,063 A * 7/1974 Festner ..... 96/73
4,071,169 A 1/1978 Dunn
4,071,334 A 1/1978 Kolb et al.
4,153,836 A 5/1979 Simm
4,172,028 A 10/1979 Dunn
4,233,037 A 11/1980 Pontius et al.
4,354,858 A 10/1982 Kumar et al.
4,379,969 A 4/1983 Cobb et al.
4,446,371 A 5/1984 Cobb
4,476,387 A 10/1984 Cobb et al.

(Continued)

OTHER PUBLICATIONS

"Burning Coal Superclean" Machine Design, Dec. 12, 2002, p. 45.

(Continued)

*Primary Examiner*—Richard L Chiesa
(74) *Attorney, Agent, or Firm*—Brown & Michaels, PC

(57) ABSTRACT

A method and apparatus electrically charges particulates that need to be removed from a moving air stream. Various methods of corona charging of particulates are used in the fields of electrostatic precipitation of dust, printers and copying machines. This invention is preferably specifically aimed at improving the separation and collection of particulates from dust, mist or vapor generating devices. In another embodiment, a grid electrostatic precipitator, in combination with a corona pre-charger, is used to remove diesel exhaust.

23 Claims, 14 Drawing Sheets

U.S. PATENT DOCUMENTS

| | | | | | |
|---|---|---|---|---|---|
| 4,477,263 | A | * | 10/1984 | Shaver et al. | 95/7 |
| 4,726,812 | A | | 2/1988 | Hirth | |
| 4,745,282 | A | | 5/1988 | Tagawa et al. | |
| 4,762,997 | A | | 8/1988 | Bergen | |
| 4,905,470 | A | | 3/1990 | Reichle et al. | |
| 5,118,942 | A | | 6/1992 | Hamade | |
| 5,203,166 | A | | 4/1993 | Miller | |
| 5,426,936 | A | | 6/1995 | Levendis et al. | |
| 5,485,253 | A | | 1/1996 | Osbourne | |
| 6,004,375 | A | * | 12/1999 | Gutsch et al. | 95/57 |
| 6,176,902 | B1 | | 1/2001 | Matsubara | |
| 6,287,368 | B1 | * | 9/2001 | Ilmasti | 96/19 |
| 6,373,680 | B1 | | 4/2002 | Riskin | |
| 6,482,253 | B1 | | 11/2002 | Dunn | |
| 6,585,809 | B1 | | 7/2003 | Parsa | |
| 6,773,489 | B2 | | 8/2004 | Dunn | |
| 6,872,238 | B1 | * | 3/2005 | Truce | 95/29 |
| 7,105,041 | B2 | * | 9/2006 | Dunn | 96/66 |
| 2004/0035292 | A1 | | 2/2004 | Dunn | |
| 2004/0226446 | A1 | | 11/2004 | Dunn | |
| 2006/0187609 | A1 | * | 8/2006 | Dunn | 361/230 |

OTHER PUBLICATIONS

White, Harry J. "Industrial Electrostatic Precipitation" Addision-Wesley Publishing Company, Inc. MA, 1963, p. 159.

* cited by examiner

GRID ELECTROSTATIC PRECIPITATOR/FILTER FOR DIESEL ENGINE EXHAUST REMOVAL

REFERENCE TO RELATED APPLICATIONS

This application claims an invention which was disclosed in Provisional Application No. 60/675,575, filed Apr. 28, 2005, entitled "CORONA PARTICLE CHARGER", Provisional Application No. 60/722,026, filed Sep. 29, 2005, entitled "CORONA PARTICLE CHARGER", and Provisional Application No. 60/716,425, filed Sep. 13, 2005, entitled "GRID ELECTROSTATIC PRECIPITATOR/FILTER FOR DIESEL ENGINE EXHAUST REMOVAL". The benefit under 35 USC §119(e) of the U. S. provisional applications is hereby claimed, and the aforementioned applications are hereby incorporated herein by reference.

This application is also a continuation-in-part of parent patent application entitled "GRID TYPE ELECTROSTATIC SEPARATOR/COLLECTOR AND METHOD OF USING SAME", Ser. No. 10/872,981, filed Jun. 21, 2004, now U.S. Pat. No. 7,105,041, which is a continuation-in-part of parent patent application entitled "GRID TYPE ELECTROSTATIC SEPARATOR/COLLECTOR AND METHOD OF USING SAME", Ser. No. 10/225,523, filed Aug. 21, 2002, now U.S. Pat. No. 6,773,489. The aforementioned applications are hereby incorporated herein by reference.

FIELD OF THE INVENTION

The invention pertains to the field of electrostatic filters and precipitators. More particularly, the invention pertains to grid electrostatic precipitator/filters for diesel engine exhaust removal and for corona particle chargers for use in electrostatic precipitators.

DESCRIPTION OF RELATED ART

There have been some prior art methods developed for pre-charging particles.

U.S. Pat. No. 4,726,812, METHOD FOR ELECTROSTATICALLY CHARGING UP SOLID OR LIQUID PARTICLES SUSPENDED IN A GAS STREAM BY MEANS OF IONS, discloses a method for electrostatically charging particles suspended in a gas stream by means of ions originating from a separate unipolar ion source. The ions are injected into the gas stream by means of an alternating field and are deposited on the particles.

U.S. Pat. No. 6,482,253, POWDER CHARGING APPARATUS, relates to an apparatus and method to electrostatically charge or neutralize particles conveyed in a pneumatic stream. More particularly the invention is drawn to an apparatus that has at least two longitudinal chambers separated from each other with a plate electrode. Within each chamber is at least one corona charging electrode with multiple discharge points and at least one power level zone. The apparatus divides a single gas stream into a multiple streams where corona discharge polarizes or neutralizes particles with a similar or dissimilar polarity causing coalescing or separation of the particles as they exit the charging chambers.

U.S. Pat. No. 6,773,489, GRID TYPE ELECTROSTATIC SEPARATOR/COLLECTOR AND METHOD OF USING SAME, discloses an electrical type grid electrostatic collector/separator that removes particles from an air stream. The apparatus includes multiple parallel grids that act as the porous material, enclosed in a sealed compartment so that the entrained air flows parallel and between one or more centrally located grids. A direct current high voltage field is established between the grids with the polarities alternating between facing grids. When non-conductive particles are present, external methods of pre-charging by corona discharge are preferably used. When non-conductive particles are present, both internal and external methods of pre-charging by corona discharge are used.

Diesel engines in the prior art utilizes either a metallic or ceramic filter to collect carbon residue that is periodically heated to oxidize and remove the carbon. Corning Incorporated is one manufacturer of the prior art filters.

U.S. Pat. No. 4,905,470, ELECTROSTATIC FILTER FOR REMOVING PARTICLES FROM DIESEL EXHAUST, discloses an electrostatic diesel exhaust filter where the corona electrode and the collecting electrode are supplied with direct voltage with an AC component to obtain an even discharge. A catalyst may be placed in the exhaust gas pipe upstream from the electrostatic filter so that the hydrocarbons also contained in the exhaust gas may be oxidized. Placing the catalyst upstream from the electrostatic filter enhances the removal of the hydrocarbons.

U.S. Pat. No. 5,203,166, METHOD AND APPARATUS FOR TREATING DIESEL EXHAUST GAS TO REMOVE FINE PARTICULATE MATTER, discloses an emission control system with dual catalyzed diesel particulate filters in communication with an exhaust stream and a pair of heater elements each associated with one of the filters. Exhaust gas is transmitted and uniformly heated through the filters.

SUMMARY OF THE INVENTION

The present invention includes a method and apparatus that electrically charges particulates that need to be removed from a moving air stream. Various methods of corona charging of particulates are used in the fields of electrostatic precipitation of dust, printers and copying machines. One embodiment permits both positive and negative ions to be generated in close proximity to each other. The corona particle chargers are preferably specifically aimed at improving the separation and collection of particulates from dust, mist or vapor generating devices.

An apparatus for removing particles from a single air stream includes an input for the air stream entering the apparatus, an output located on an opposite side of the apparatus from the input, a plurality of grid electrodes located between the input and the output, and a corona pre-charger. When opposite charges are applied to adjacent grid electrodes, an attractive field is created and the particles in the air stream pass through at least one grid electrode. The air stream is preferably selected from the group consisting of a single column of air flowing in a vertical direction and a single row of air flowing in a horizontal direction. The apparatus preferably removes exhaust from a diesel engine.

DETAILED DESCRIPTION OF THE INVENTION

Figure 1:
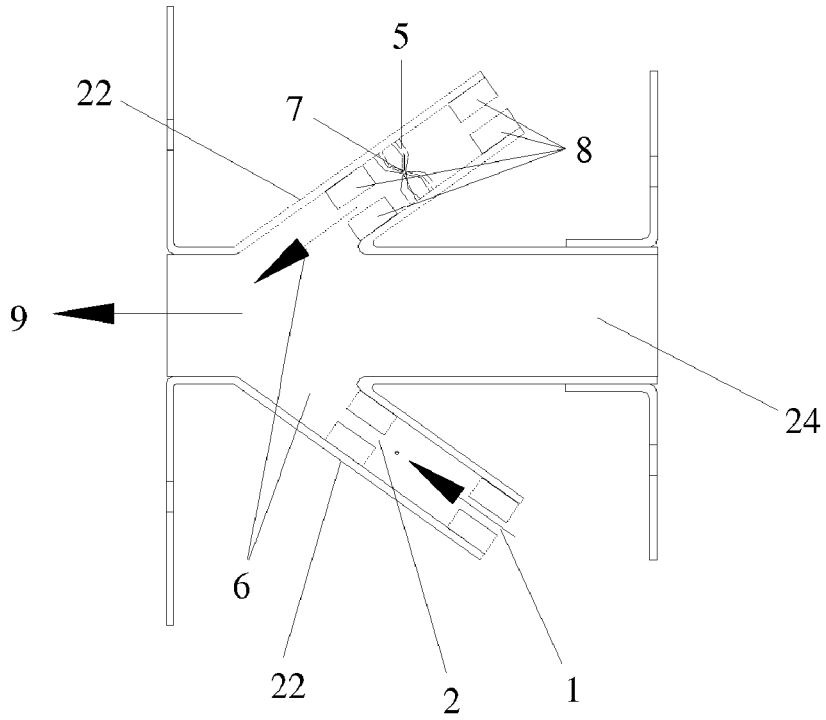
FIG. 1 shows a cross-sectional view of a corona generating electrode design that uses a 45 degrees angle chamber on each side of the main entrained airflow passage.

The present invention is preferably a dynamic system with entrained air flowing between the charging and attracting electrode. Separated particles are collected by gravity or on a plate electrode. The plate electrode is located in a relatively static air environment and out of the moving air stream. This eliminates the normal particle re-entrainment during plate cleaning.

Unlike the prior art precipitators, the grid electrostatic precipitator/collector (GES/C) apparatus of the present invention separates the solid particles from the air stream by using an induced electric field between two grid electrodes, and uses a combination of a corona field to generate the necessary polarized ions and either charged or grounded grids to attract the particles laterally or perpendicular to the airflow.

The basic design of the various filter and precipitator embodiments described herein use either wire or woven wire grids to laterally remove particles from a moving air stream. Methods known in the art are used to charge and collect the particles.

The GES/C system introduces the particles by an entrained gas stream that flows between two electrodes. Both electrodes preferably have a high voltage direct current each having a different polarity. In a preferred embodiment, the arrangement has one polarized charging electrode and an opposing electrode at ground potential.

Dry particulate precipitators in the prior art are generally composed of apposing plate and corona wire electrode combinations. Both in the proposed and standard precipitators, particles can be charged prior to entering the deposition area or in an area where both corona charging and deposition operations occur.

The charged particles are separated from the air stream when they traverse laterally through one or more grids until they are out of the influence of the air stream. Lateral movement of the particles occurs because each grid has the opposite polarity that develops an attractive field perpendicular to the air stream. This electrode arrangement induces an electrical stress on the particles resulting in a continuous movement of the particles away from the preceding grid electrode.

For conductive and semi-conductive particles, the particles move freely through the grids and away from the air stream. The number of grids and the spacing between grid wires can vary depending on the volume and air velocity and the solids concentration. The more conductive, higher density particles that have moved out of the air stream are collected by gravity. Finer particles that tend to remain suspended are generally carried out of the system by the larger particles.

For non-conductive particles that retain their charge, a more open grid structure can be used as well as continuous tapping of the grid electrodes. This allows for a freer lateral movement of the charged particles to the collecting plate electrode.

For a mixture of conductive and non-conductive particles where the non-conductors are not charged triboelectrically or by corona discharge, the non-conducting particles will pass through the apparatus with the air stream while the conducting particles will be removed laterally by electrical attraction and collected independently of the non-conducting particles. If required the non-conducting particles can be separated by a second process.

Particles generally do not adhere to the first grid because of the rapid air movement. Non-conductive particles have more of a tendency to adhere to the grids and can be dislodged by tapping, vibration or reverse polarity methods. The particles that are dislodged from these grids continue to flow laterally because the similar particle polarities repel the particles from each other.

A relatively static air movement zone collects the particles by allowing both conductive and non-conductive particles to fall by gravity or be collected on the plate electrode. The GES/C designs of the present invention maintain a controlled $\Delta P$ distribution that prevents internal turbulence that would interfere with the normal lateral flow of the particles. However, moderate, controlled turbulence between the main two electrodes is preferred. In most operations a sufficient negative air pressure exists at the exit end of the precipitator so the air moves as a uniform column.

The successful transfer of particles through the grids is based on the lateral electrical field attracting force being greater than the force of the transient airflow. The particles that pass through the grid follow the flux lines that are generated between progressive grid wires. The same effect occurs when a combination of a cone surface and grid wires is used. The passage through the grids is also related to the particle-to-particle interaction, angle of particle movement, particle momentum, and the relation of particle size to the grid opening. A cone-shaped electrode attenuates the airflow and at the same time increases the particle and airflow resistance by gradually increasing the surface area that the air travels over.

The present invention uses electrical field effects to remove entrained conductive and semi-conductive particles from an air stream by causing electrically polarized charged particles to move laterally or near perpendicular through and between vertical grids while the clean gas continues to be drawn out of the apparatus.

The present invention also removes entrained, charged non-conductive particles by using a combination of corona discharge electrodes, parallel grid electrodes and collecting plate electrodes that, when electrically active, cause the lateral movement of charged particles through the grids while the gas continues to flow out of the system.

Vertical, parallel multi grids separate and remove particles from the entrained gas stream. A horizontal apparatus removes and collects particles from the entrained gas stream. The design preferably includes a top solid plate electrode with parallel grid electrodes located below the plate electrode.

Entrained airflow is preferably contained and directed so that the separated material does not become re-entrained in the air stream. To achieve this, the present invention draws the air through the apparatus, preferably by having a blower located at the exhaust end of the apparatus. This creates a negative pressure operation in a sealed unit. In addition, input and output apertures are preferably included to allow a row or column of air to flow between the main inner electrodes. This prevents the flow of air from deviating and creating turbulence on the backside or static airside of the center main electrodes.

The present invention also collects separated particles by using a combination of gravity, plates and grid electrodes. Powder collected by the plates or the grids can be removed by squeegee or rapping or by other conventional methods.

Variable wire grid spacing along the length of the apparatus compensates for changes in both particle concentration and the finer size particles being collected. Separate electrical power zones along the length of the apparatus vary the field strengths. The present invention also improves the efficiency and rate at which entrained particles are charged and removed from an air stream.

When the apparatus of the present invention is used to separate dissimilar materials from a moving air stream, generally the conducting particles are separated from the non-conducting particles. The less conductive material is discharged with the exiting air and collected in a separate operation. Separation depends on a number of factors. Some of these factors include, but are not limited to, the difference in electrical properties, conductivity and dielectric constant (the larger the difference the better), particle size distribution, the percentage of conductive versus non-conductive particles, and density difference. Examples include the separation of materials found in fly-ash, minerals or ore products.

When processing entrained materials that have a high percentage of non-conductors, the non-conductors may have been triboelectrically charged, leaving a residual surface charge that should be removed prior to entering the separator. This is preferably accomplished by subjecting some materials to a HVAC corona discharge prior to entering the separator/collector.

The methods used to collect particles that have been separated and removed from the air stream vary depending on the electrical properties and the size of the particles. Collecting electrodes are preferably either plates or multi grid assemblies. The collecting electrodes can be grounded or have a high voltage AC, or a high voltage DC applied with the opposite polarity from the main grid electrodes.

A high concentration of similarly polarized particles can repel each other, causing some of the particles to transfer back into the main air stream. Therefore, the location and design of the collecting electrodes becomes a major factor when removing a high concentration of polarized electrically charged dust particles from an air stream. A solution to the problem is to capture or deposit these particles as quickly as possible.

Figure 17:
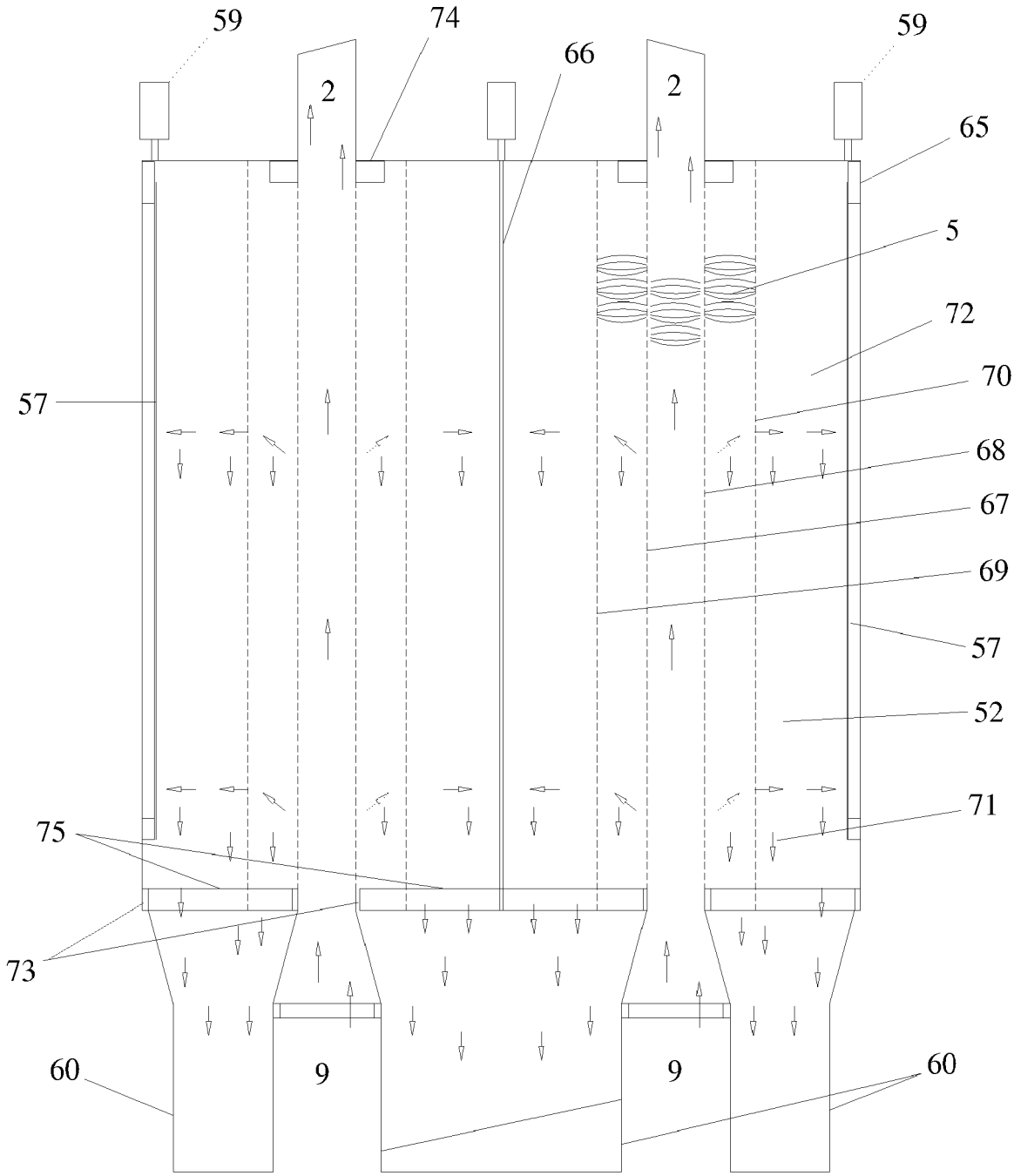
FIG. 17 shows a cross sectional view of a cylindrical or rectangular multiple grid separator/collector of the present invention.

FIG. 17 illustrates a cross-section of a preferred embodiment of a vertical, rectangular, dual vertical GES/C of the present invention. The apparatus includes a structural frame 65 and a center support plate electrode 66 with entrained gas entering at 9 and exiting at 2. It is important to have a narrow column (or row) of airflow and good control of the internal pressure. The air stream is preferably drawn into the apparatus. The entrained gas flows between a polarized charging grid 67 and the ground potential grid electrode 68. Directly behind the two input grids 67 and 68 are additional grid electrodes 69, at ground potential, and a charged grid 70. It should be understood that the apparatus could be expanded laterally so that other grid electrodes can be used to move the particles further from the air stream. The apparatus is also a sealed unit so that the air stream is restricted between the input 9 and the gas exit conduits 2. This unit can be designed to operate with the input air moving either vertically or horizontally through the apparatus.

An electric field 5 is established between the alternating electrodes 67 and 68, 68 and 69, and 69 and 70. Generally the spacing between the last grid electrodes 69 and 70, and the plate electrode 57 results in the absence of an electric field because of the distance between the plate and the grid electrodes. The charged particles move laterally 52, and gravitationally settle 71 in the open space 72.

When processing large, high-density particles, these particles may gravitate out of the process before the next grid electrode or the collection plate electrode 57. The collecting plate electrode 57 is used when collecting fine non-conductive particles or when there is a mixture of conducting and non-conducting particles. Deposited particles are removed by a tapping apparatus 59, or by a squeegee or other removal methods. The spacing between parallel grid electrodes preferably varies between ⅜ and 1.50 inches.

The spacing between electrodes, the electrical potential between electrodes and the number of grid electrodes are each a function of the concentration of solids in the air stream, the size of the particles, electrical and physical characteristics of the particles, and flow rate, as well as other process variables.

The grid supports 73 and 74 are preferably constructed from a dielectric material with openings 75 in the collection area. The dislodged powder falls by gravity or is tapped from the plate electrodes 57 and is collected 60 at the bottom of the precipitating chamber.

Figure 18A:
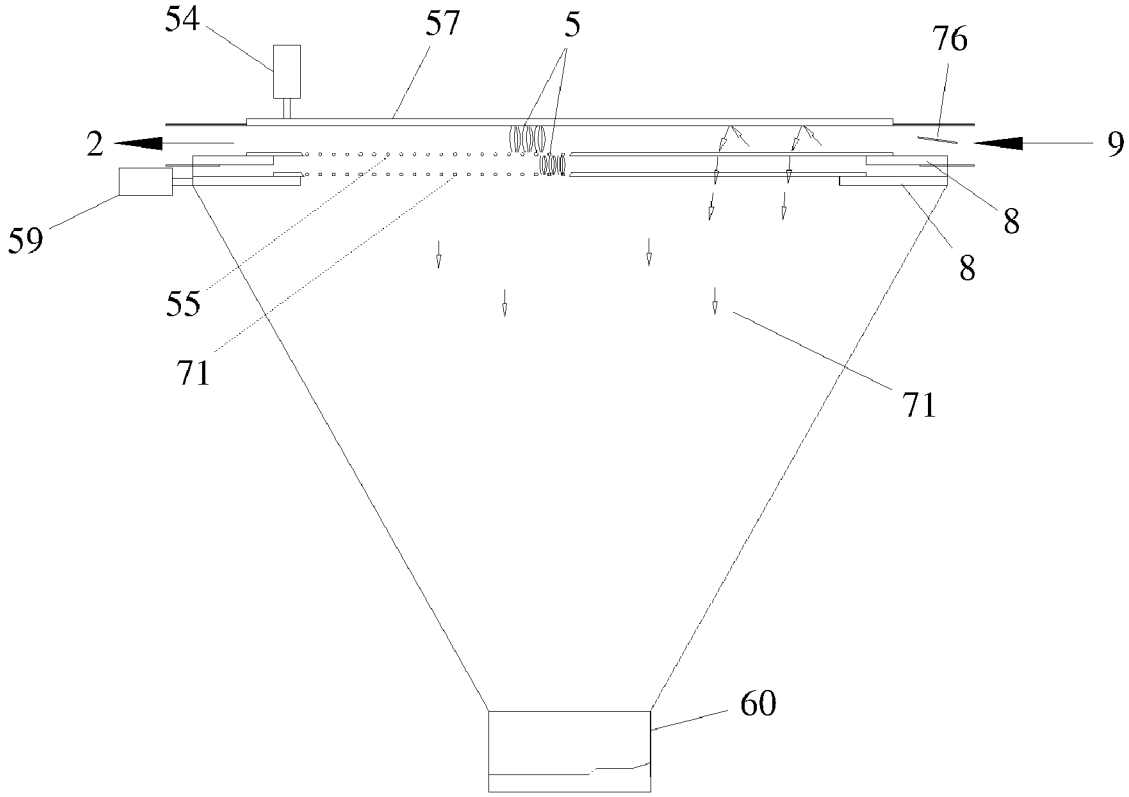
FIG. 18*a* shows a cross sectional view of a horizontal apparatus of the present invention that has a top plate electrode and multiple grids below.

FIG. 18*a* is a cross sectional view of a horizontal, rectangular operating unit primarily designed to process conductive materials. This precipitator preferably operates in an elevated position, where space and height are limited.

The collection and separation process is similar to the previous embodiments in that the entrained conductive particles are charged by induction as soon as they enter the electrode area. The apparatus is designed so that either the plate 57 or the wire grid electrode 55 can function as the charging electrode. By making the plate electrode 57 the charging electrode, the particles are first attracted to the plate and then the wire grid electrode 55. Particles are removed from the apparatus by passing through the first and second grids 55 and 56 and then falling by gravity 71 into the powder receptacle 60. With the polarity arrangement discussed above, the grid 55 is at ground potential and the plate 57 and the grid 56 electrodes operate in a charging mode. Depending on the distance between electrodes, the normal electrical operation is preferably between 15 and 30 KVDC. In a preferred embodiment, a deflector plate 76 that directs the entrained input air to flow toward the plate or wire grid electrode is also included in the design.

Figure 18B:
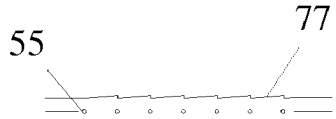
FIG. 18*b* shows a side view of a horizontal apparatus of the present invention that uses a contour electrode in place of the plate electrode.

FIG. 18*b* adds a component to enhance the performance of the unit shown in FIG. 18*a*. This embodiment replaces the plate electrode 57 with a contour electrode 77 with a matching wire pattern. The contour electrode 77 adds turbulence and periodically deflects the air stream towards the grounded electrode 55, resulting in a more efficient removal of the particulates.

The corona particle charger (CPC) apparatus and method to charge particles, evolved out of the development of the Grid Electrostatic Filter/Precipitator (GEF-P). In the early design of the GEF-P, the CPC corona charging wires were located in the air stream. During the early testing of the GEF-P it was noted that the designed narrow airflow caused an increase in the concentration of particles entrained in the air stream resulting in a reduction in field strength, an unstable corona operation and a high attrition of the corona wires. The present invention not only solves these problems but also results in substantially improving on the corona charging of particulates.

A method of generating ions in a chamber and externally affecting particle charging in the main air stream is discussed in U.S. Pat. No. 4,726,812. One major difference is with the chamber and how the corona and attracting electrodes are related and how the high voltage is coupled into the circuit. The use of an external alternating circuit to affect and influence the behavior of the free ions in the main air stream is not considered relevant to the present invention. Both generate ions in a separate chamber and inject the ions through apertures into the air stream. Ions generated in the prior art apparatus have a low chance of surviving with its electrode arrangement. The electric field that is between the ionization source 3 and the perforated plate 9 in the prior art attracts most of the ions generated to the perforated electrode and is discharged to ground.

In one embodiment, the present invention focuses on the relation of air movement between the main particle entrained air stream and the separate corona air stream and how this influences the physical arrangement and relationship of both the charging and attracting electrode.

The invention includes a method and apparatus that can electrically charge particulates that need to be removed from a moving air stream. Various methods of corona charging of particulates are used in the fields of electrostatic precipitation of dust, printers and copying machines. This invention is preferably specifically aimed at the separation and collection of particulates from dust, mist or vapor generating devices.

Precipitators may have corona electrodes upstream from the collecting plates, between the collecting plates or in the more recent hybrid unit, external of bag filters. The early charging apparatus used concepts found in the author's U.S. Pat. No. 6,482,253, herein incorporated by reference, where an attracting plate is located between the corona electrodes. Other methods were tried using the standard practice of putting the charging wire electrodes directly in the path of entrained airflow between plate electrodes. In all these applications, the corona electrodes are exposed to the entrained particle airflow, resulting in a high attrition of the corona wires and loss of corona charging efficiency.

With the first RGEP (Rectangular Grid Electrostatic Precipitator), the design of the corona-generating electrode uses a 45-degree angle chamber; see FIG. 1. The input orifices 1 and output orifices 2 permit controlled amounts of air to be drawn into the chamber 22 to be electrically charged and mix in a narrow channel 24 with the main entrained air flow 9.

Figure 2:
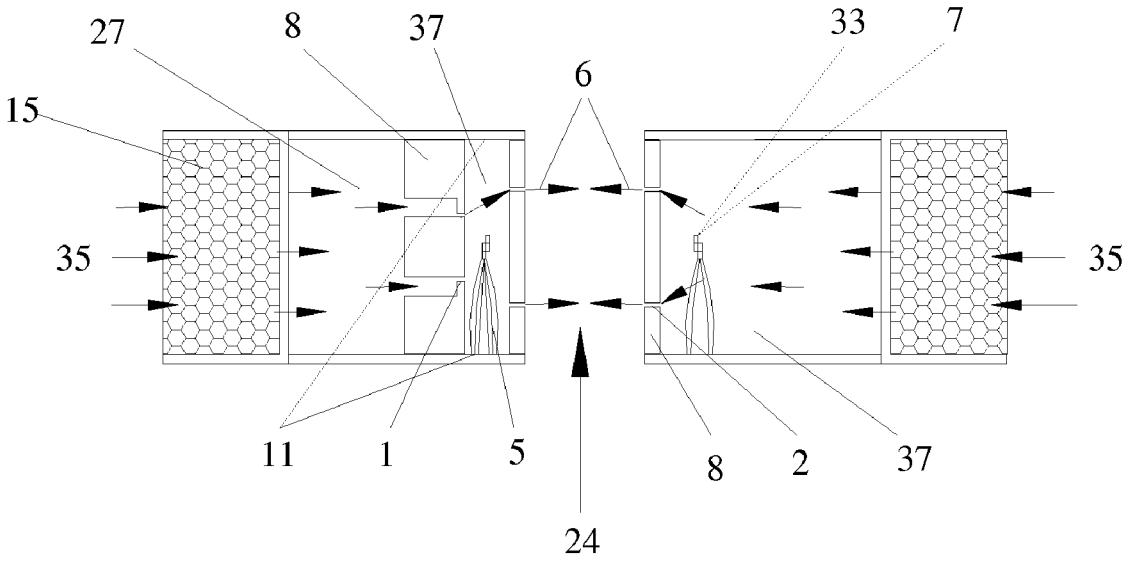
FIG. 2 shows a cross-sectional view of two saw tooth corona electrodes located in a corona chamber with each electrode facing an attracting electrode, where gases pass through the electrical field into a control orifice and into the main entrained air stream.

Two other designs are also being used with the GEF-P. One of the arrangements, shown in FIG. 2, shows a cross-sectional view of two saw tooth corona electrodes 33 in an elongated corona chamber 37 attached together and facing in the opposite direction. The tips of the saw tooth corona electrode face the grounded attracting plate electrodes 11 and operate with an electrical field 5 between the two electrodes 33 and 11.

On the left hand side of FIG. 2 the gases 35 to be charged are filtered and enter through a control orifice 1 close to the charging electrodes, pass through a HVDC electric 5 field and exit through another controlling orifice or aperture 18 near the attracting plate electrode 11. The spacing between the corona electrode 33 and the dielectric material 8 are preferably in the low 1 or 2 thousandths to 10 or more depending on the flow conditions of the main air stream 9 and the need to have enough flow and velocity of air and ions to keep the corona electrodes 18 clean. The chamber behind the first input orifice 1 acts as a plenum chamber 27 that provides a uniform distribution of air to the corona-charging electrode 7.

The right hand side shows a slight modification where the input gases 35 are drawn through the air filter 15, but do not pass through controlling apertures 1. The input gases 35 only exit through the controlling apertures 2 near the attracting plate electrode 11. Selection of the location of the input orifice and the exit orifice is important because it permits the generated ions entering the main entrained air stream to exit the chamber before losing their charge to the attracting electrode. Other design and operating features of this apparatus include the ability to increase the distance between the corona 5 and attracting electrodes 11 so that a higher voltage is generated and maintained, resulting in the production of more ions.

Figure 3:
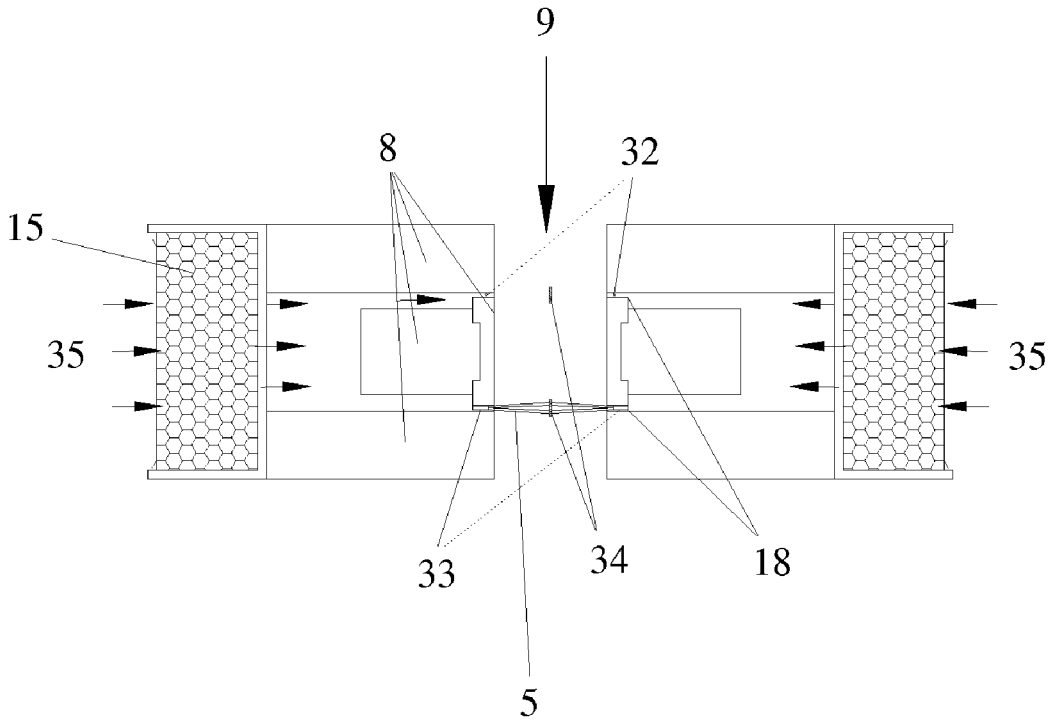
FIG. 3 is a cross-sectional view showing two opposing corona-charging electrodes, one wire electrode, and another saw tooth electrode that are located in an aperture where gases to be charged flow around the corona charging electrodes.

FIG. 3 shows another method of improving ion generation and still protecting the charging electrode. The corona electrodes are located in the slotted apertures or orifices 18 made of dielectric material 8 that is not affected by the corona discharge and where the gases to be charged 35 flow close to or over the surface of the corona electrodes 32 and 33 and become ionized and are attracted to the plate or ribbon electrodes 34 that are centrally located between the corona electrodes, by the HVDC electric field. The ribbon attracting electrodes are centrally located between the opposing corona electrodes and in the retained airflow.

The corona electrodes generate controlled amounts of electrically charged gases that are attracted to the opposing attracting electrode by the electrical field 5. These charged particles are preferably drawn into the main stream 9 by negative pressure of the GEF-P, or forced into and mixed under low pressure with the main entrained airflow 9. Having the ability to protect the corona-generating electrode opens the door to extending the life of electrodes and generating higher ion counts using less energy.

The high velocity gases and particulates in the main air stream 9 keep the attracting electrodes 34 clean. The charging corona electrodes 32 and 33 are kept clean by the positive constant flow of gases over the surface of the electrodes. Clearance between the electrode and sidewall of the orifice may vary and is based on operating parameters of the GEP.

It should be noted that, in the case of designs shown in FIGS. 2 and 3, the number of corona electrode units, inline with the airflow, are examples only. The number may vary, depending upon the application for which the design is being used.

Figure 4A:
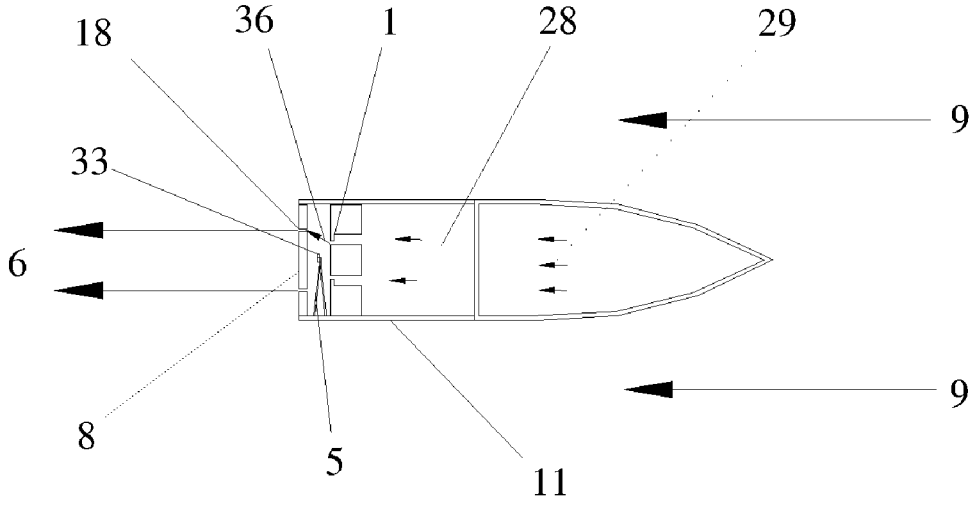
FIG. 4*a* is a cross-sectional view of a longitudinal saw tooth corona electrode apparatus used in front of a standard precipitator to inject ions parallel to the entrained air stream.

FIG. 4*a* is a cross-sectional view of a saw tooth corona electrode 33 apparatus used in front of a standard precipitator that injects ions 6 parallel and into the entrained air stream. The front end of this apparatus is similar to the design shown in FIG. 2.

Figure 4B:
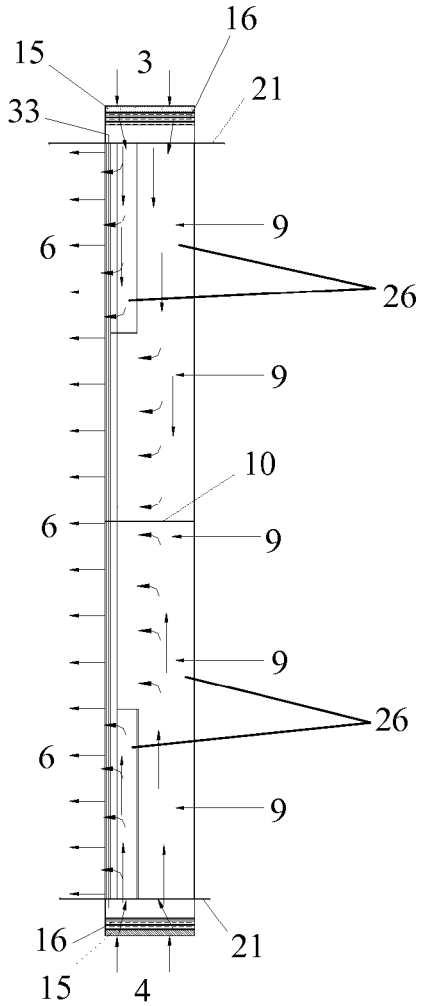
FIG. 4*b* is an elevation view of FIG. 4*a* showing location of air filters and heaters at both ends of the chamber.
Figure 6:
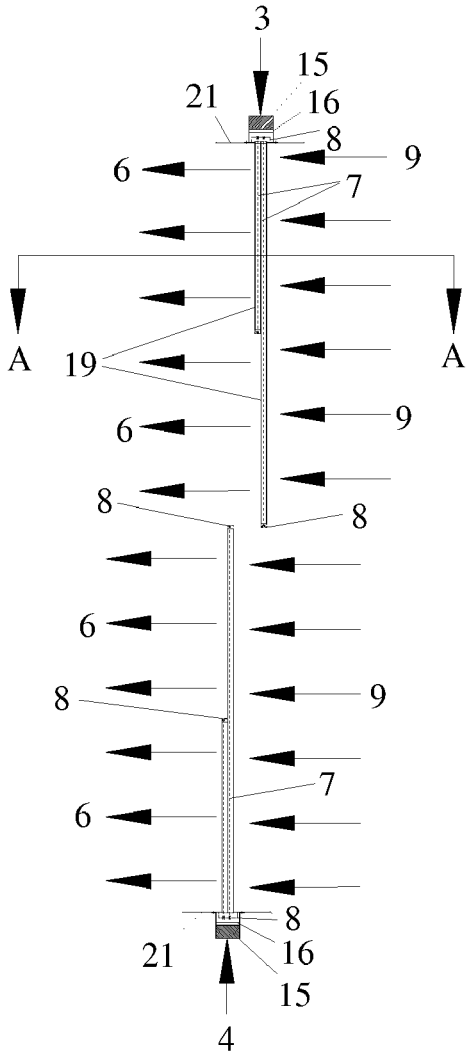
FIG. 6 shows an elongated dual corona chamber divided in half.

FIG. 4*b* is an elevation view of FIG. 4*a* showing the location of air inputs top 3 and bottom 4 with filters 15 and heaters 16 at both ends of the corona generating apparatus. The overall length requirements determine whether the chamber is divided into two separate units at the midpoint 10 by dividing the plate; one half extending from the bottom and the other half extending from the top of the precipitator (FIG. 6). Each half is preferably further divided into two additional corona chambers 26. The reasons for this change would be either for structural or improved air distribution or both structural and improved air distribution.

Figure 4C:
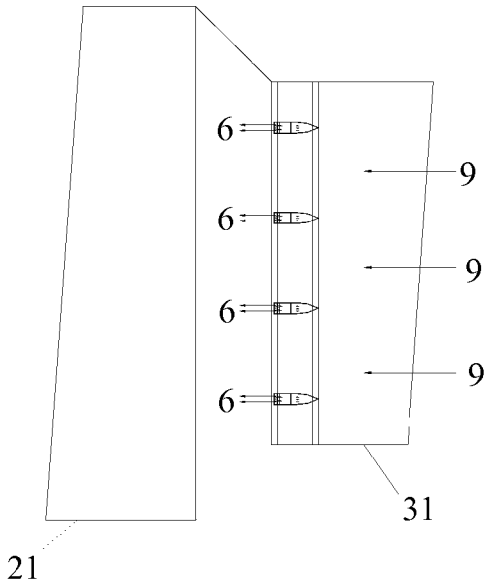
FIG. 4*c* is a top view of how the corona charger would be used with a standard precipitator.

FIG. 4*c* is a top view illustrating how a multiple corona charging apparatus would be preferably installed in the ductwork 31 of a standard precipitator 21. The filters and heaters are not shown in this view.

Figure 5:
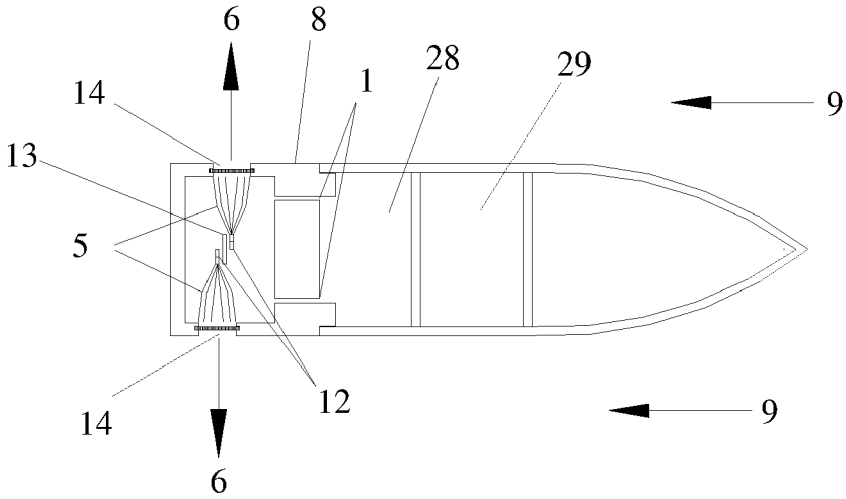
FIG. 5 is a cross-sectional view of a corona chamber that injects ions through a porous plate electrode laterally into the main entrained air stream.

In FIG. 5, the corona chamber design shows the expelled ions 6 flowing perpendicular into the main particle entrained air stream 9 and not parallel as shown in FIG. 4*a*. Perpendicular flow may be favored in a standard precipitator operation because of the improved chance of ion contact with particulates in the retained airflow. In this design, the gases are drawn into a dual corona chamber unit, 28 and 29, and within each chamber enter through the orifice 1 to be charged. Ions that are created are ejected into the main air stream 9 through a porous conductive plate electrode 14 or a plate with multiple slots. Note the dual corona chambers are also shown in FIG. 4*b*. The saw tooth electrodes are separate and have a ribbon heater between the two electrodes. The purpose of heating the corona electrodes is to maintain a more constant generation of ions.

Another feature of this design is a method used to heat the corona electrodes 12. By placing a ribbon heater 13 between the two saw tooth corona electrodes 12, a more uniform heat distribution is obtained resulting in better control of ion generation.

FIG. 6 shows both an elongated dual corona chamber 37 divided in half and the use of a slotted stainless steel elongated tube 19 as a corona chamber 37. The location of the corona electrode 7 in the tube may vary depending on the air velocity and orifice opening required.

Figure 7:
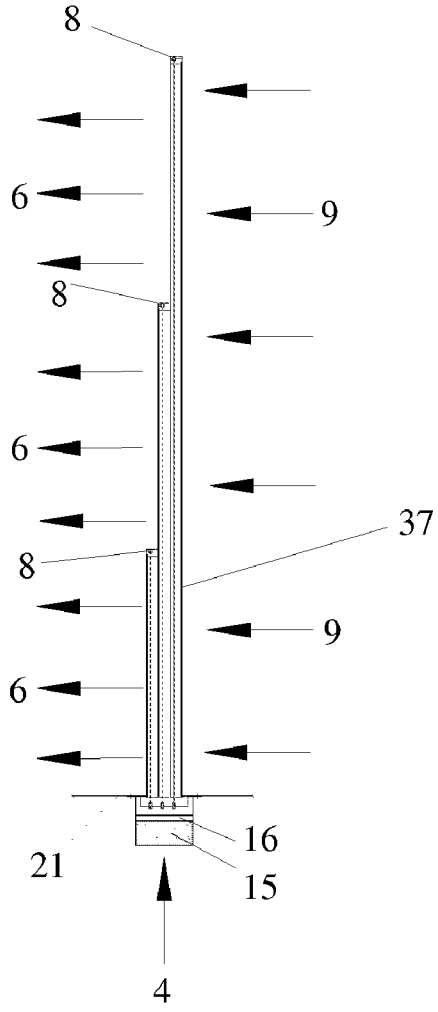
FIG. 7 shows the lower half of an elongated corona chamber that is composed of three elongated corona chambers in series.

FIG. 7 shows the lower half of an elongated corona chamber 37 that includes three elongated corona chambers in series. Increasing the number of corona chamber tubes 37 is one method of improving the distribution of the air in the corona chamber and is critical in achieving a uniform vertical distribution of ions 6.

Figure 8:
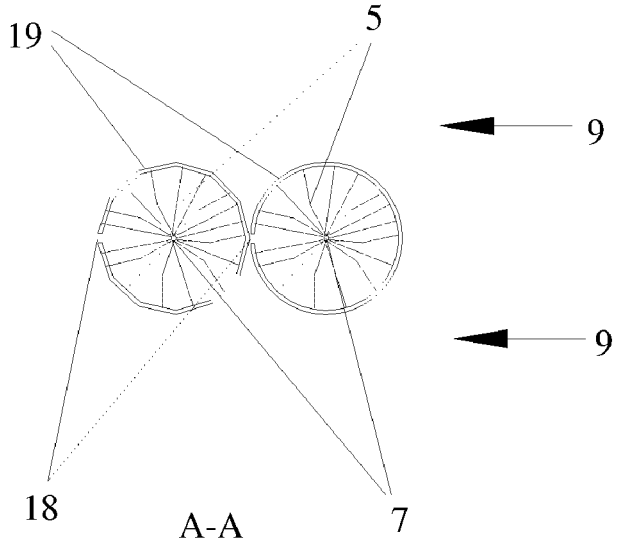
FIG. 8 is a cross-sectional view, at position A-A of FIG. 6.

FIG. 8 is a cross-sectional view of FIG. 6, at A-A that shows details of a dual elongated corona tube chamber 19. In this model, the corona wire electrode 7 is centrally located in the cylindrical tube type corona chamber 37. Offsetting the corona electrode 7 towards the elongated slotted orifice 18 increases the field strength and the number of ions injected into the output orifice 2.

Figure 9:
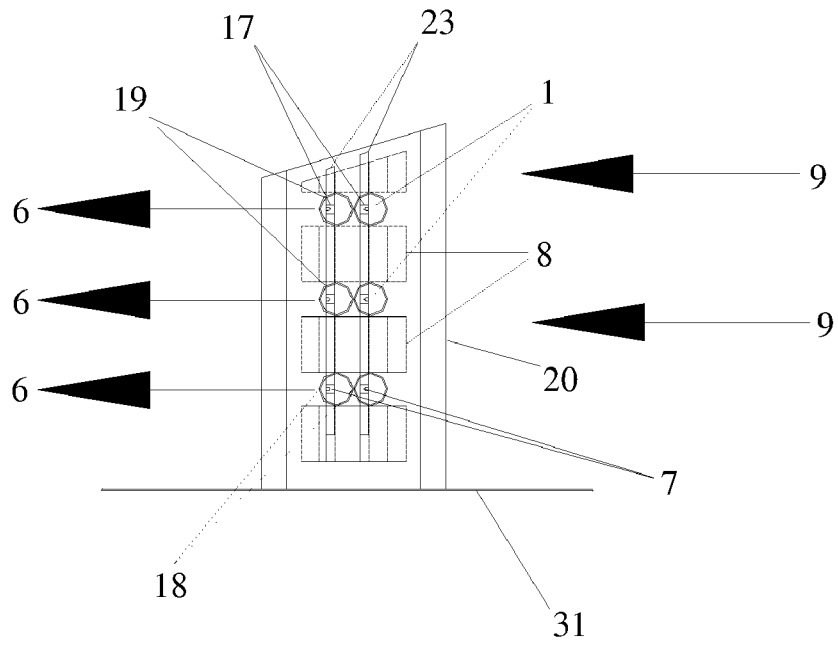
FIG. 9 is a plan view showing three cylindrical slotted tube corona chambers in series.

FIG. 9 is a plan view showing three cylindrical slotted tube corona chambers 37 located in the duct-work 31 of a standard dry precipitator used in a fly ash collection operation. Other features shown include an outline of an electrical enclosure 20 with corona electrical connectors 17 joining the corona electrodes 7 by an electrical bus bar 23.

Figure 10:
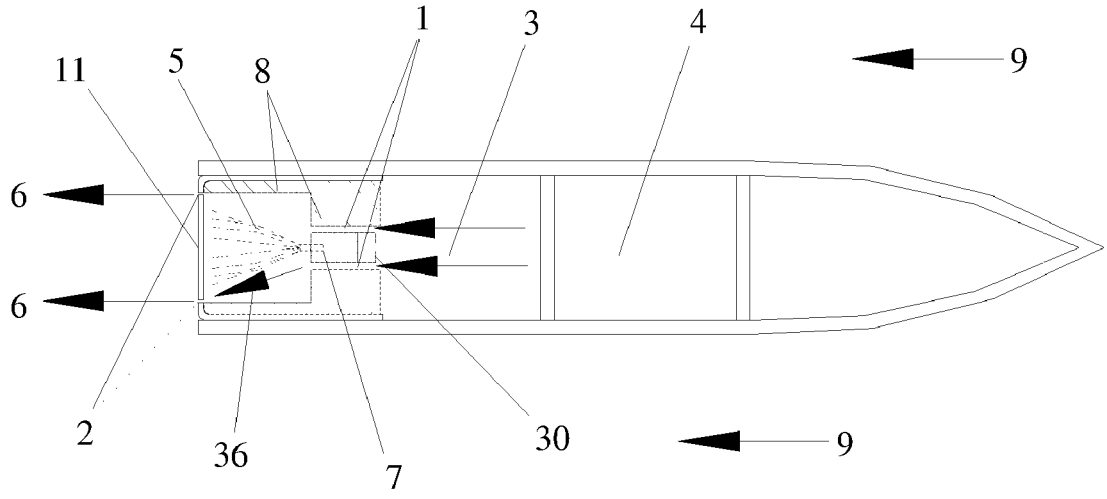
FIG. 10 is a cross-sectional view of a model that has an electrode support that can be adjusted.

FIG. 10 is a cross-sectional view of a dual chamber 3 and 4 model that has an electrode support 30 that can be adjusted to change the spacing and direct the flow 36 between the corona electrode 7 and the attracting electrodes 11. The corona electrode 7 is preferably adjusted to maintain the highest possible voltage during changes in external operating conditions or for charger related operating parameter changes such as air temperature or type of gas used in conjunction with the air. Maintaining high corona voltage and field strength yields a higher momentum to the ions towards the attracting electrode 11 and the output orifice 2.

Having the corona electrode not exposed to the particulates provides a major advantage by producing a more consistent generation of ions. These designs offer a number of advantages; the use of finer wire or saw tooth electrodes that use less energy and have a lower onset voltages, preheated gas or air to lower the density that again can affect the onset corona voltage and a stronger electric field between the opposing electrodes resulting in a lower work function and a more uniform corona along the length of the corona electrode. A more detailed explanation on what effects corona performance can be found in books published by Leonard B. Loeb (*Electrical Coronas*, Leonard B. Loeb, Library of Congress, No. 64,18642, 1965 University of California Press) and Harry J. White (*Industrial Electrostatic Precipitation*, Harry J. White, Library of Congress, No. 62-18240, Copyright 1963 Addison-Wesley Publishing Company, Inc.), herein incorporated by reference.

Figure 11:
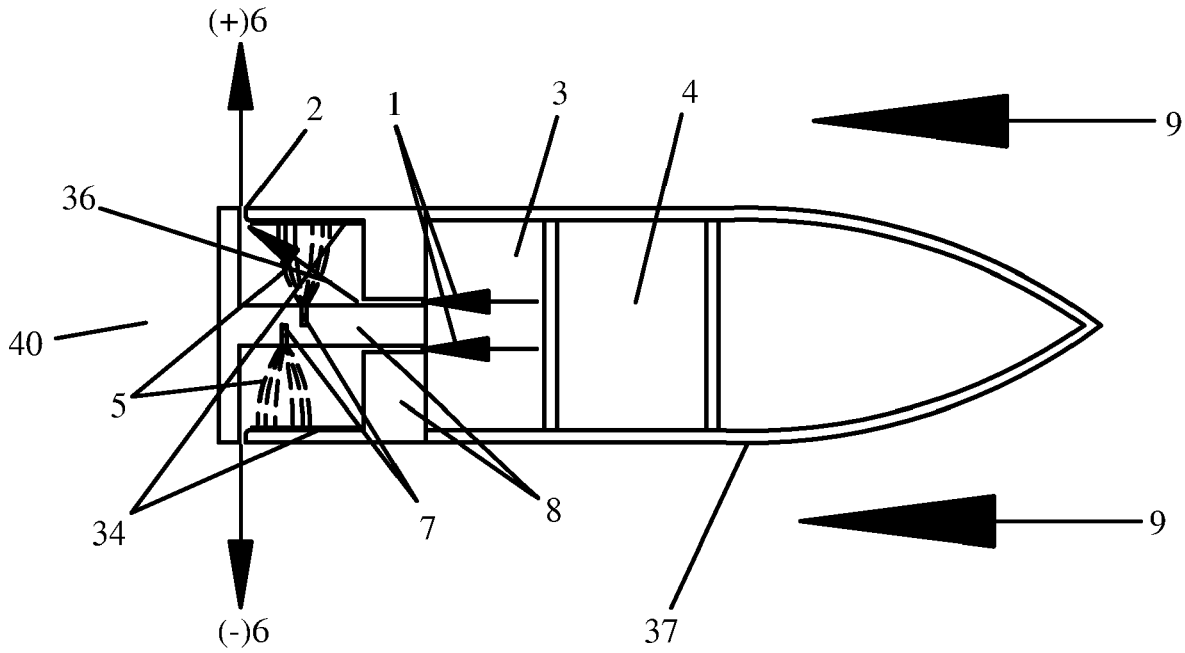
FIG. 11 is a cross sectional design similar to FIG. 5, except the two corona electrodes are isolated from each other so that they can operate with different polarities.
Figure 12B:
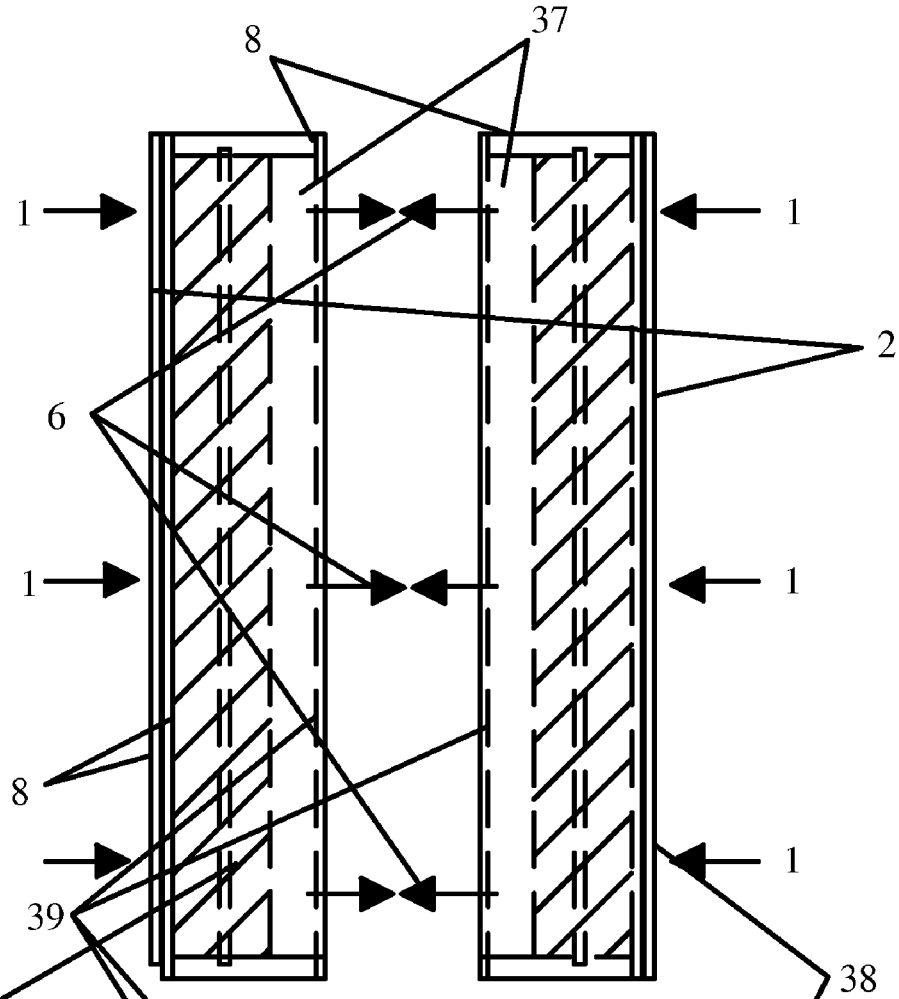
FIG. 12*b* is a plan view of FIG. 12*a*.
Figure 12A:
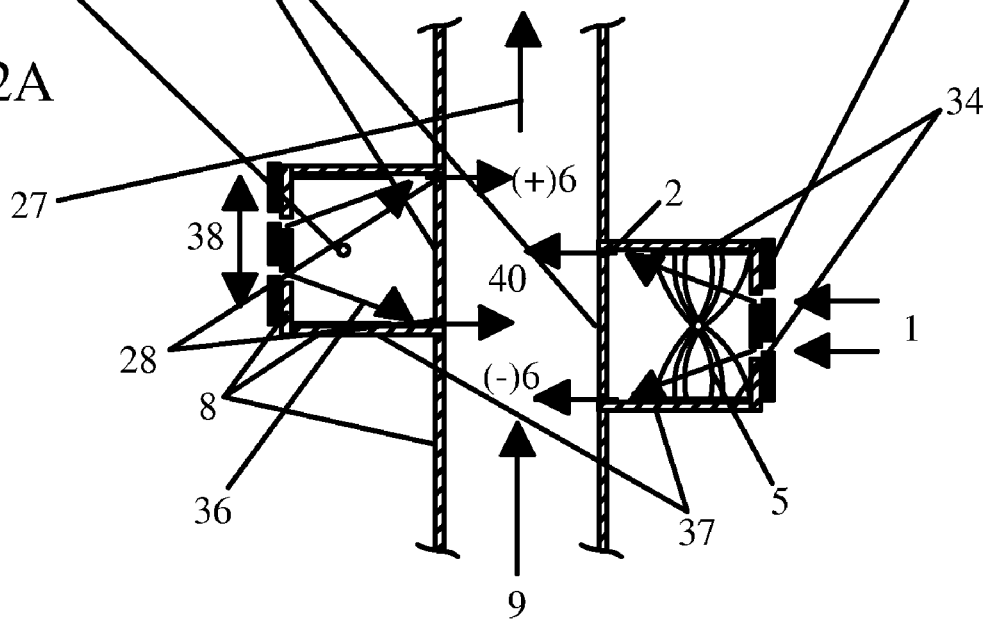
FIG. 12*a* is across sectional view of two opposing, offset corona chambers that can operate with similar or opposing polarity.

FIGS. 11, 12*a* and 12*b* show a design where both negative and positive ions can be generated in proximity to each other. FIG. 11 shows a single corona chamber housing 37 with two corona electrodes 7 insulated 8 from each other. Ions 6 injected into the entrained air stream 9 charge particles that pass the corona chamber housing 37 and mix in the air turbulent zone 40. The oppositely polarized particles 6 combine to form larger particles that are more efficiently removed by the electrostatic precipitator that is located downstream from the corona charger. Further operation details for this model are discussed with respect to FIG. 5.

FIG. 12*a* is a cross sectional view of two opposing, offset corona chambers 37 that can operate with either similar or opposing polarities 6. By offsetting the two corona chambers 37, turbulence and mixing 40 are induced in the area where the ions are injected into the entrained air-stream 9. Particles that become polarized 27 with opposite charges are attracted to each other and form larger particles that are more efficiently removed by the electrostatically precipitator that is located downstream from the corona charger.

FIGS. 12*a* and 12*b* illustrate corona chambers 37 or corona pre-chargers designed to support the ability of the GEF-P to separate and collect non-conducting particles. Other important features are that the corona charging electrodes 7 are not in the entrained air stream 9; therefore, they are not subject to attrition by the entrained particles, and the air drawn into 1 the corona chamber 37 or pre-charger may be filtered and regulated by the sliding aperture 38. The corona chamber 37 is preferably designed so that the distance between the corona electrode 7 and the top and bottom conductive plates 34 is great enough to allow for a strong electric field 5 and the air flow 36 is designed to cut across the electric field 5 and close enough to the corona electrode 7 to generate ions. These ions 6 are then drawn into the entrained air stream 9 and into the RGEP. The corona chamber is preferably constructed using mostly dielectric material except for the corona electrodes 7 and the ribbon or plate electrodes 34.

The present invention also combines a modified Rectangular Grid Electrostatic Precipitator (RGEP), (as disclosed in U.S. Pat. No. 6,773,489 and U.S. Patent Publication No. 2004-0226446) and a Corona Pre-Charger (CPC), as discussed above, to remove non-volatile dry soot particulates and optionally organic volatiles emitted from the exhaust of a diesel engine. The present invention re-circulates a portion of the unburned fuel without particulates that can damage the engine. This is preferably accomplished by diverting some of the exhaust from the blower back into the engine intake. A combined filter and RGEP effectively remove carbon exhaust. In this arrangement, the life of the filter is extended by reducing the number of thermal cycles required and the length of time required to oxidize the carbon because the larger particles are removed by the RGEP.

Although the present application does not show all of the possible component combinations that are used to compensate for various engine operating conditions, those alternative designs are within the scope of the present invention. The RGEP of the present invention is able to collect carbon exhaust from diesel engines having many different configurations.

U.S. Pat. No. 5,426,936 (Levendis and Abrams) shows that the technique of exhaust gas recirculation (EGA) can lead to a fifty to sixty percent reduction in NO emissions by re-circulating ten to fifteen percent of the exhaust gas. However, re-circulation reduces the amount of oxygen for combustion, thus increasing the amount of CO and particle emissions. Another concern in any re-circulating system is the return of particles that may damage the engine. Ceramic filters used in this circuit age due to the thermal cycling, potentially resulting in abrasive particulates being carried back to the engine.

Thermal operating conditions of a diesel engine generally fluctuate between 200° and 1200° Fahrenheit, resulting in a variation in the amount and type of carbon emission. This is within the operating conditions for wire-plate type precipitators as specified in the EPA document EPA-425/F-03-028, incorporated herein by reference. The thermal cycling of an RGEP requires that the grid electrodes be free to expand at a uniform rate and maintain a constant spacing.

The RGEP apparatus of the present invention has an advantage over standard precipitators in that the corona generating electrode is not located in the entrained air-stream. Instead, it is located in a separate chamber adjacent to and part of the input duct (conduit) system. Particulates are drawn between and pass through the corona pre-charger where the ions generated are drawn into the entrained air stream through control orifices. These injected ions become attached to the carbon particles just before entering the RGEP chamber. Since the pre-charger is in close proximity to the strong electric field of the RGEP, the charged particles immediately react, follow the flux line of force and move laterally out of the air stream.

The air that is drawn into the corona is optionally varied by either a sliding aperture or by varying the cubic feet per minute (CFM) of the blower. The air flow has a thermal affect on the pre-charger and the RGEP as well as on the ion count injected into the entrained air stream.

The charged particles entering the separating chamber are laterally removed from gas flow by the electrical field that is established between the two opposing grid electrodes. The carbon particulates are collected in a relatively static air zone on collecting grids that are located parallel and behind the main grid electrodes and on an interior surface of the outer walls. The collected material is allowed to accumulate to a size that, when removed from the collecting grid electrodes and outer walls by impact, falls by gravity as a cluster into a collecting chamber without being re-entrained into the air stream. Particles collected in the container may be removed and disposed of at specific intervals or, if economically feasible, heated to oxidize the carbon.

Both the regulated air input at the corona pre-charger and the oxygen ions generated by this method help remove the carbon particles.

Figure 13B:
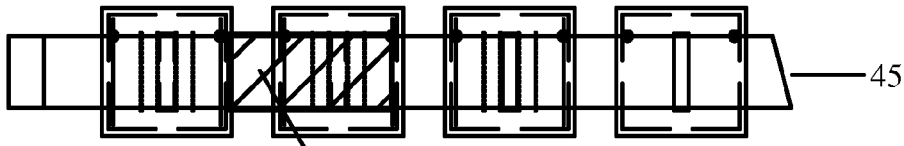
FIG. 13*b* shows a top view of FIG. 13*a*.
Figure 13A:
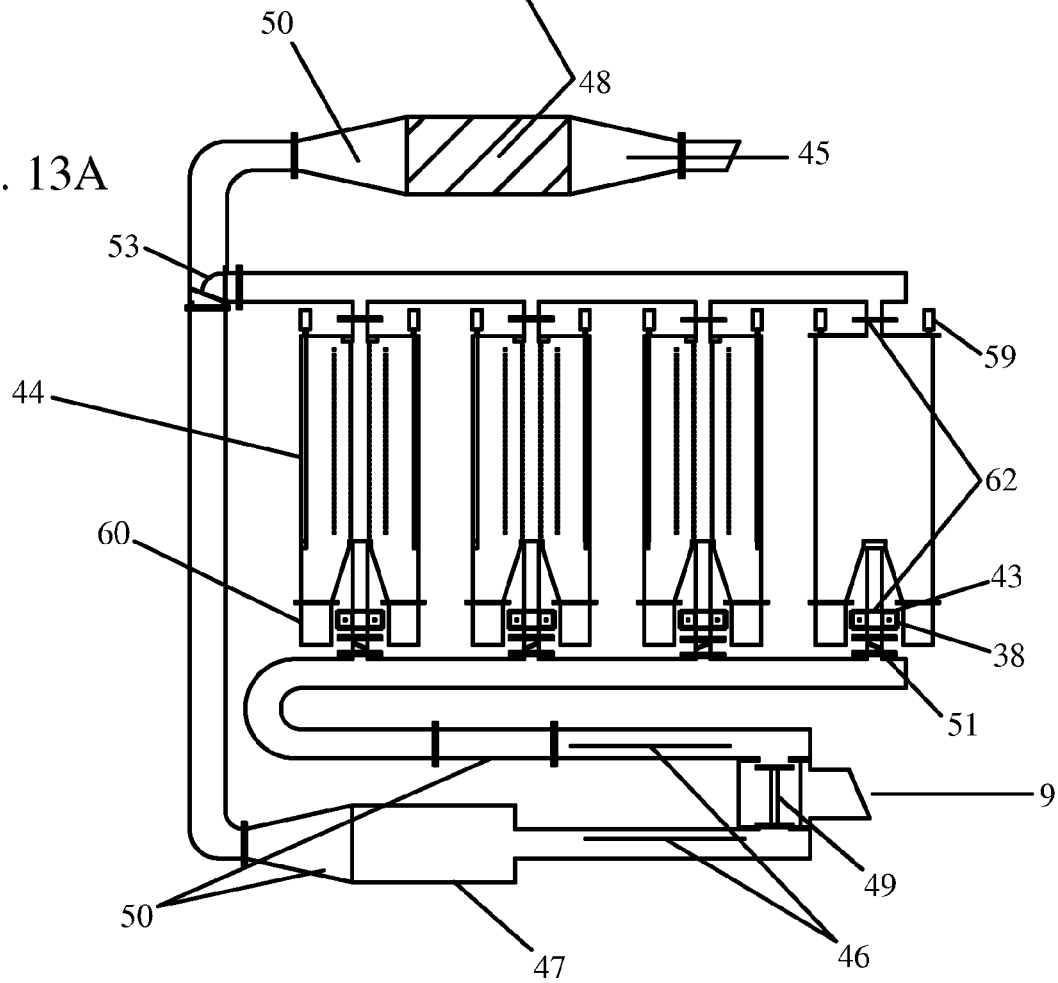
FIG. 13*a* shows a parallel arrangement of a multiple RGEP (rectangular grid electrostatic precipitator) plus a combined system incorporating a ceramic filter and a proportional control valve in an embodiment of the present invention.

FIG. 13 shows a bypass arrangement using multiple RGEP 44 units. Although four RGEP 44 units are shown in FIG. 13*a*, this number has been chosen merely as an example to illustrate the invention. The number and size of the RGEP units are variable and depend on the size of the diesel engine and its operating conditions. Other factors that may affect the process include the arrangement of components such as the location of the catalytic converter, the ceramic filter, the pressure control valve and, if needed, a heat exchanger.

Disposal of the collected carbon may be accomplished by one or more of several alternative methods:

1. After an operating period of 8 or more hours the collection containers 60 are removed at a designated disposal site. In one embodiment, the carbon is removed and the container is put back into service. In another embodiment, if the container is disposable, it may be discarded at the site and replaced with another disposable unit.

2. If the containers 60 are made of ceramic material, they are heated similar to the ceramic filters of the prior art to remove the carbon.

3. Removing the RGEP 44 unit, quick disconnect 62, and replacing it with one that has been serviced.

The components and operation of the RGEP 44 shown in FIGS. 13*a* and 13*b* include a variable speed blower 45 that may be regulated to maintain the necessary air velocity in the RGEP. The entrained air or exhaust enters at an air input 9. The split entrained airflow 46 is directed to flow either into the RGEP 44 or through the ceramic filter 47 and into the catalytic converter 48 by a proportional control valve 49. The proportional control valve 49 is preferably controlled by a sensor (not shown). Examples of a sensor that may be used include, but are not limited to, a temperature sensor, a pressure sensor or an opacity sensor. The entrained air 9 first preferably goes through a transition conduit 50 that changes the flow from a cylindrical flow to a rectangular flow and is then directed into the RGEP 44 and then through a control valve 51 that determines which unit is in operation. The entrained air then flows between two opposing pre-chargers 43 where ions 6 (see FIG. 15*b*) are generated and injected into the entrained air flow 9 and become attached to the carbon particles.

Figure 14B:
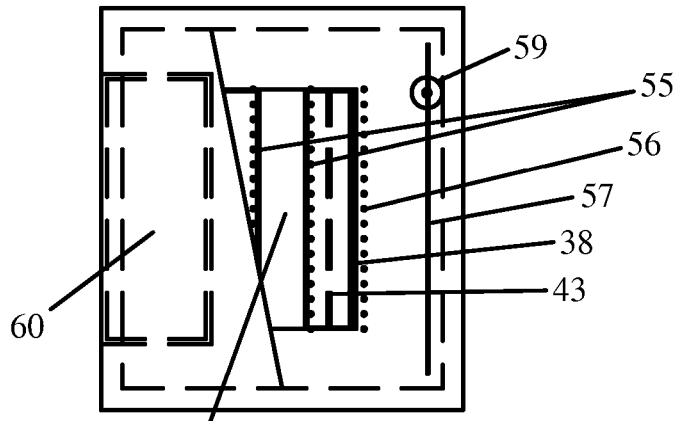
FIG. 14*b* is a cross-sectional top view of the RGEP of FIG. 14*a*.
Figure 14A:
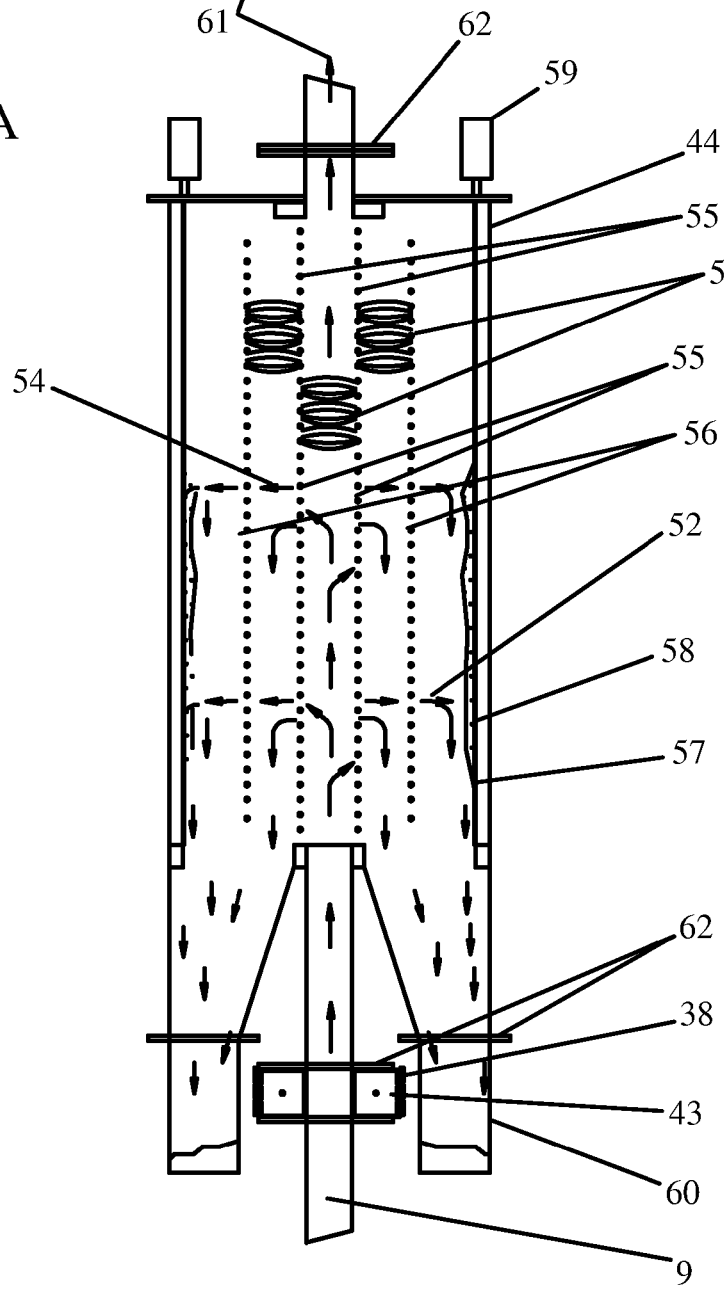
FIG. 14*a* shows a cross-sectional elevational view of the RGEP of FIG. 13*a* with an external corona pre-charger.

The charged carbon particles respond to the electrical field and move laterally out of the air stream 52, as shown in FIG. 14*a*. The carbon removed gas then passes through the bypass or check valve 53. This valve prevents gases from flowing back into the exit end of the RGEP 44 when only the ceramic filter 47 is in operation.

FIGS. 14*a* and 14*b* show a more detailed view of the RGEP 44. Charged particles 54 enter and respond to the electrical field 5 and move laterally 52 through the main grid electrodes 55 and towards the collecting grid 56 and plate 57 electrodes.

Particles collected on the plate electrode 58 are allowed to accumulate so that they fall by gravity, when impacted using an impactor 59, as clusters. FIG. 14*b* illustrates the relative position of the pre-charger 43 and the collection container 60 with respect to the input 9 and exit 61 conduits.

Figure 15B:
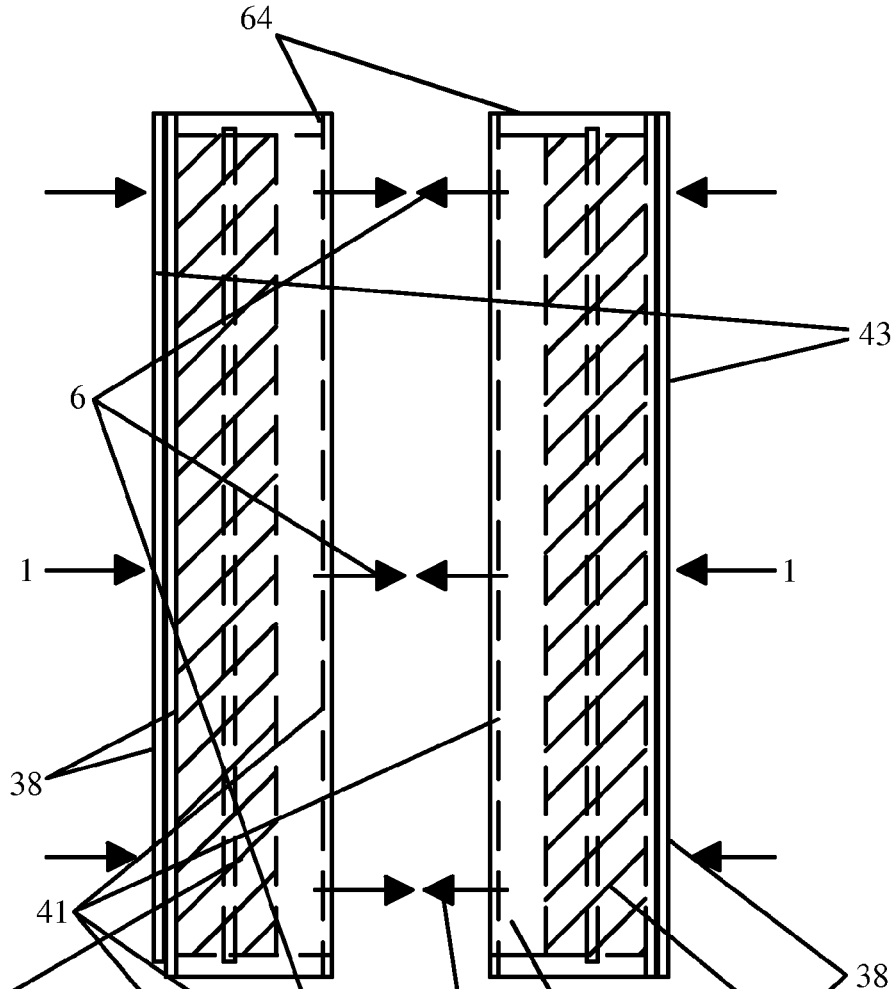
FIG. 15*b* is a cross-sectional top view of the pre-charger of FIG. 16*a* used with the RGEP.
Figure 15A:
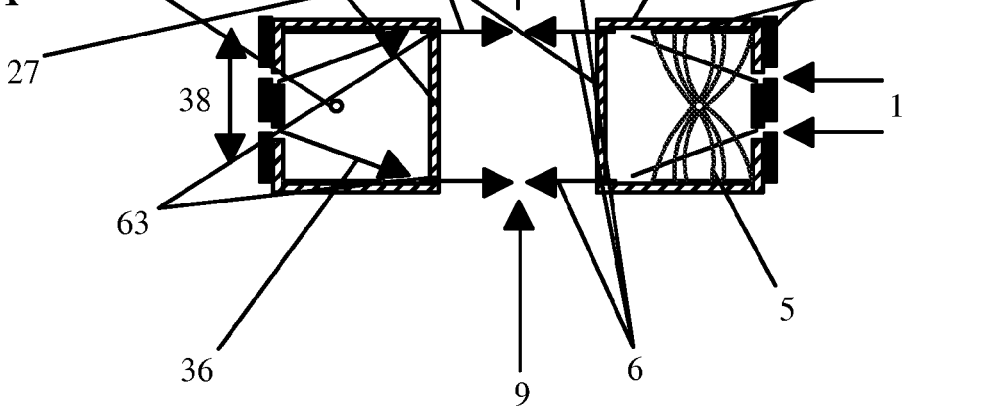
FIG. 15*a* is a cross-sectional elevational view of the pre-charger used with the RGEP of FIG. 13*a*.

FIGS. 15*a* and 15*b* show a detailed view of the pre-charger 43, similar to the pre-charger shown in FIGS. 12*a* and 12*b*. Two features of the pre-charger 43 support the ability of the RGEP 44 to function. One is that the corona charging electrodes 7 are not subject to attrition by the entrained particles in the main input air stream 9. In addition, air drawn into 1 the pre-charger 43 may be filtered and regulated by the sliding aperture 38. The pre-charger 43 is preferably designed so that the distance between the corona electrode 7 and the top and bottom conductive plates 11 is great enough to allow for a strong electric field 5. The air flow 36 cuts across the electric field 5 and gets close enough to the corona electrode 7 to generate ions. These ions are then drawn into 6 the entrained air stream 9 and into the RGEP 44 through the fixed apertures 63. This air supply 1 may also function to control the operating temperature of the RGEP but also the supply of oxygen to catalytic converter 48. The end support 64, the adjustable plate components 38, the aperture faceplate 41 and the top and bottom sides 42 are preferably made from dielectric material.

Figure 16:
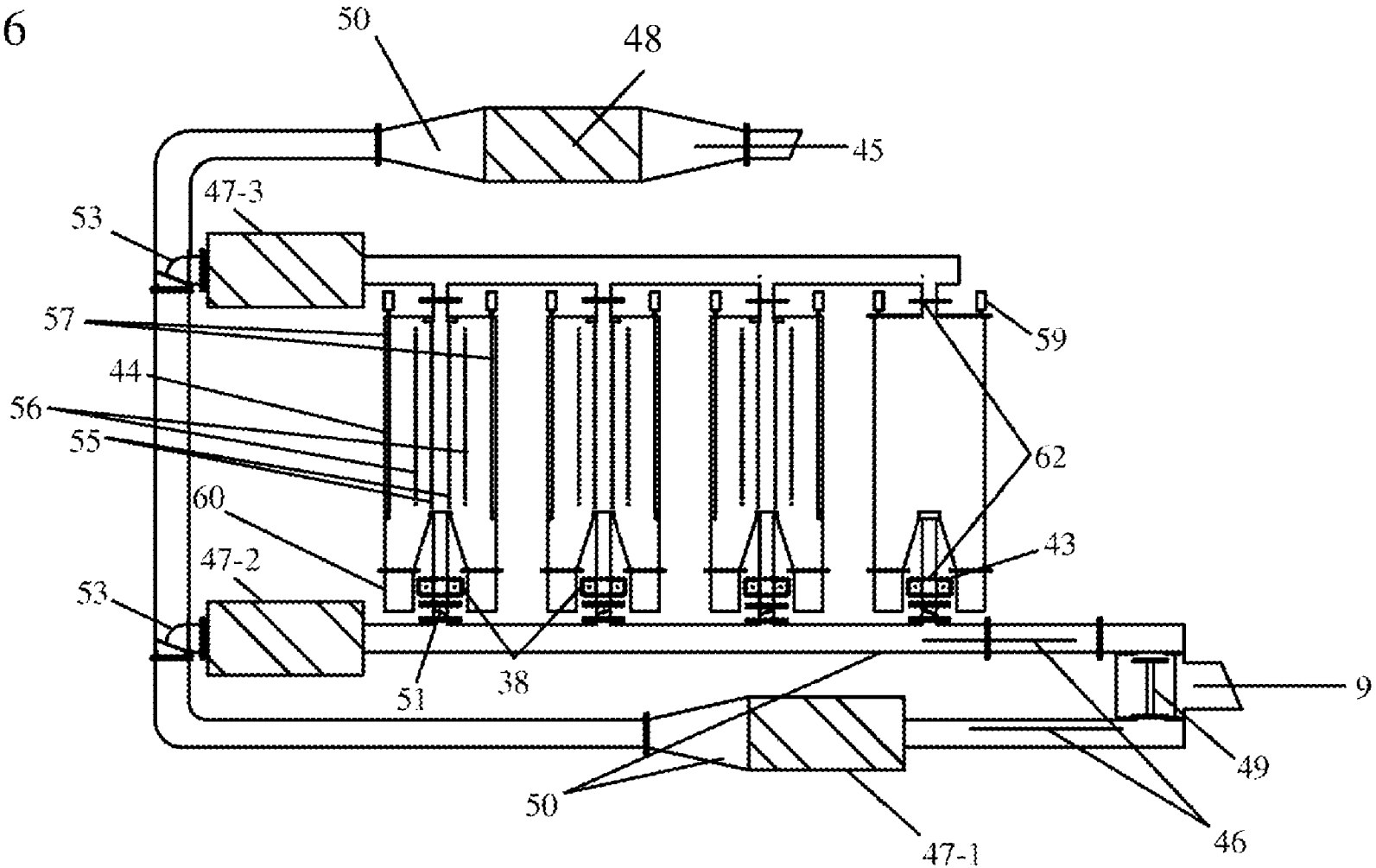
FIG. 16 is a cross-sectional elevational view of an RGEP of the present invention with multiple filter locations in an embodiment of the present invention.

FIG. 16 illustrates one example of filters used in conjunction with the multi RGEP 44. The filter 47-1 is the same as the filter 47 shown in FIG. 13. When used inline with the REGP, the control valves 51 are preferably adjusted so that either a proportional amount enters the RGEP 44 and the filter 47-2 or either device may be isolated from the other by control valve 51. The filter 47-3 is used after the exhaust is processed through one or more RGEP 44 units. If this arrangement is effective in collecting the carbon, the filter does not have to be as large nor thermally cycled as frequently.

There are many advantages to the present invention. The device of the present invention, when used in conjunction with filters, may extend the life and reduce the size required for a given application by removing the larger particulates. The present invention may also be used to replace a filter for some applications. In addition, it may increase the ability to return some of the diesel exhaust to the input manifold of the diesel engine. The present invention also may increase the performance of the catalytic converter by providing additional oxygen.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of removing a plurality of carbon particles from a single air stream in a diesel engine, comprising the steps of:

a) passing particles through a corona pre-charger to generate ions;

b) drawing the ions into the single air stream such that the ions become attached to the carbon particles; and c) passing the air stream between a plurality of grid electrodes, each grid electrode having an opposite polarity as the grid electrodes adjacent to it such that an attractive field is created and the attractive field causes the particles pass through at least one grid electrode into a static air movement zone where particles are collected.

2. The method of claim 1, wherein the air stream is selected from the group consisting of a single column of air flowing in a vertical direction and a single row of air flowing in a horizontal direction.

3. The method of claim 1, further comprising the steps of attracting the particles which have passed through a grid electrode to the next attracting grid electrode until the particles are out of the air stream in the static air movement zone and collecting the particles in a collection vessel.

4. The method of claim 3, further comprising the step of heating the collection vessel to remove the carbon particles.

5. The method of claim 3, further comprising the steps of removing the collection vessel and disposing of the carbon particles.

6. The method of claim 5, further comprising the step of reinstalling the collection vessel for further collection.

7. The method of claim 5, wherein the collection vessel is a disposable collection vessel, further comprising the step of replacing the disposable collection vessel with another disposable collection vessel.

8. The method of claim 1, further comprising the step of utilizing a negative air pressure as the particles are being removed from the air stream.

9. The method of claim 1, further comprising the step of drawing the air stream into an apparatus comprising the grid electrodes and the static air movement zone.

10. An apparatus for removing exhaust from a single air stream in a diesel engine, comprising:

a) an input for the air stream entering the apparatus;

b) an output located on an opposite side of the apparatus from the input, wherein the air stream exits the apparatus at the output;

c) a corona pre-charger located outside the single air stream, wherein the corona pre-charger generates a plurality of ions and wherein the ions are drawn into the single air stream such that the ions become attached to a plurality of carbon particles; and d) a plurality of grid electrodes located between the input and the output;

such that when opposite charges are applied to adjacent grid electrodes, an attractive field is created and the carbon particles in the air stream pass through at least one grid electrode into the static air movement zone where the carbon particles are collected.

11. The apparatus of claim 10, wherein the air stream is selected from the group consisting of a single column of air flowing in a vertical direction and a single row of air flowing in a horizontal direction.

12. The apparatus of claim 10, farther comprising at least one sliding aperture that controls the amount of air that is drawn into the corona particle charger.

13. The apparatus of claim 10, farther comprising at least one collection vessel that collects the carbon particles.

14. The apparatus of claim 13, wherein the corona pre-charger comprises at least one air filter.

15. The apparatus of claim 13, wherein the collection vessel is disposable.

16. An apparatus for charging particulates that need to be removed from an entrained air stream, comprising:

a) an electrostatic precipitator comprising:

i) an input for the air stream entering the precipitator;

ii) an output located on an opposite side of the precipitator from the input, wherein the air stream exits the apparatus at the output;

iii) a plurality of grid electrodes located between the input and the output; and iv) a static air movement zone;

such that when opposite charges are applied to adjacent grid electrodes, an attractive field is created and the particles in the air stream pass through at least one grid electrode into the static air movement zone where the particles are collected; and b) a corona pre-charger located outside of the air stream, wherein the corona pre-charger generates a plurality of ions and wherein the ions are drawn into the entrained air stream such that the ions become attached to a plurality of particles in the precipitator.

17. The apparatus of claim 16, wherein the air stream is selected from the group consisting of a single column of air flowing in a vertical direction and a single row of air flowing in a horizontal direction.

18. The apparatus of claim 16, wherein the corona pre-charger comprises at least one saw tooth corona electrode.

19. The apparatus of claim 18, wherein the at least one saw tooth electrode comprises two saw tooth corona electrodes and the corona pre-charger further comprises at least one heater between the two saw tooth corona electrodes.

20. The apparatus of claim 16, wherein the corona pre-charger generates both positive and negative ions.

21. The apparatus of claim 16, wherein the corona pre-charger further comprises a corona chamber housing, a first corona electrode and a second corona electrode, wherein the first corona electrode and the second corona electrode are located in the corona chamber housing and the first corona electrode is insulated from the second corona electrode.

22. The apparatus of claim 21, wherein the corona pre-charger generates both positive and negative ions.

23. The apparatus of claim 16, wherein the corona pre-charger comprises a first corona chamber and a second corona chamber offset from the first corona chamber.

* * * * *

UNITED STATES PATENT AND TRADEMARK OFFICE

CERTIFICATE OF CORRECTION

PATENT NO. : 7,585,352 B2
APPLICATION NO. : 11/380714
DATED : September 8, 2009
INVENTOR(S) : Dunn It is certified that error appears in the above-identified patent and that said Letters Patent is hereby corrected as shown below:

Column 13:

Line 66: replace "ticles pass" with "ticles to pass"

Column 14:

Line 49: replace "farther" with "further"

Line 52: replace "farther" with "further"

Signed and Sealed this

Twenty-seventh Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,585,352 B2
APPLICATION NO. : 11/380714
DATED : September 8, 2009
INVENTOR(S) : John P. Dunn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 431 days.

Signed and Sealed this

Fourteenth Day of September, 2010

David J. Kappos

David J. Kappos
*Director of the United States Patent and Trademark Office*